US010948852B2

(12) United States Patent
Gonzalez et al.

(10) Patent No.: US 10,948,852 B2
(45) Date of Patent: Mar. 16, 2021

(54) GEAR SUPPORT FOR REMANUFACTURED PRINTER CARTRIDGE

(71) Applicant: CLOVER IMAGING GROUP, LLC, Hoffman Estates, IL (US)

(72) Inventors: Jesus Gonzalez, Chatsworth, CA (US); Joda Paulus, Palmdale, CA (US)

(73) Assignee: Clover Imaging Group, LLC, Hoffman Estates, IL (US)

( * ) Notice: Subject to any disclaimer, the term of this patent is extended or adjusted under 35 U.S.C. 154(b) by 0 days.

(21) Appl. No.: 16/705,750

(22) Filed: Dec. 6, 2019

(65) Prior Publication Data

US 2020/0183304 A1 Jun. 11, 2020

Related U.S. Application Data

(60) Provisional application No. 62/777,230, filed on Dec. 9, 2018.

(51) Int. Cl.
*G03G 15/08* (2006.01)

(52) U.S. Cl.
CPC ..... *G03G 15/0894* (2013.01); *G03G 2215/00987* (2013.01)

(58) Field of Classification Search
CPC ..... G03G 15/0894; G03G 21/181; G03G 21/1857; G03G 2215/0855; G03G 2215/00987; G03G 2221/1876
See application file for complete search history.

(56) References Cited

U.S. PATENT DOCUMENTS

2005/0115043 A1* 6/2005 Maeshima ..... G03G 15/0894 29/402.08

* cited by examiner

*Primary Examiner* — Thomas S Giampaolo, II
(74) *Attorney, Agent, or Firm* — Michael Best & Friedrich LLP

(57) ABSTRACT

A method of remanufacturing a toner cartridge includes obtaining a toner cartridge including a drive transmitting gear supported for rotation by an axle oriented substantially perpendicularly relative to a side surface of the cartridge. The drive transmitting gear includes an overhanging flange portion that faces and is spaced from the side surface of the cartridge to define an open space between the side surface and the overhanging flange portion. A supplemental support member may be positioned into the open space. The supplemental support member is configured to limit movement of the overhanging flange portion toward the side surface.

7 Claims, 5 Drawing Sheets

GEAR SUPPORT FOR REMANUFACTURED PRINTER CARTRIDGE

CROSS-REFERENCE TO RELATED APPLICATIONS

This application claims priority to U.S. Provisional Patent Application No. 62/777,230 filed Dec. 9, 2018, the entire contents of which are incorporated herein by reference.

BACKGROUND

The present disclosure relates to consumable cartridges used in image forming apparatuses, and more specifically to a remanufactured cartridge that has been modified during remanufacturing to improve engagement between gears that drive various components of the cartridge.

Imaging cartridges, and particularly toner cartridges, are frequently provided with a variety of gears that cooperate to drive various components of the cartridge at a desired speed. Although cartridges vary, examples of components that may be driven by cartridge gears include the developer roller, the adder roller, and toner agitator, among others. In many cases the gears are provided on one side of the cartridge and one or more of the gears may be provided with a drive receiving feature that is configured for engagement with a drive-providing feature on the printer with which the cartridge is configured to operate. When the cartridge is installed the drive-providing feature on the printer is engaged with the drive-receiving feature on the cartridge such that the printer can provide rotatable driving force to the cartridge gears and components.

During the remanufacturing process, toner cartridge remanufacturers may replace certain components of the original cartridge with new components. Examples of used components that might be replaced include seals, felts, and in some cases rollers. In some instances, replacement of these components may lead to an increase in magnitude of the torque required to rotate the gear assembly of the cartridge, stated another way, it may be more difficult to rotate the cartridge components after the remanufacturing process has been completed.

SUMMARY

In some aspects, a method of remanufacturing a toner cartridge is provided and includes obtaining a toner cartridge including a drive transmitting gear supported for rotation by an axle oriented substantially perpendicularly relative to a side surface of the cartridge. The drive transmitting gear includes an overhanging flange portion that faces and is spaced from the side surface of the cartridge to define an open space between the side surface and the overhanging flange portion. A supplemental support member may be positioned into the open space. The supplemental support member is configured to limit movement of the overhanging flange portion toward the side surface.

The method may also include removing the drive transmitting gear from the toner cartridge before positioning the supplemental support member into the open space. The method may also include replacing the drive transmitting gear onto the toner cartridge after positioning the supplemental support member into the open space. The toner cartridge may also include a gear support defining an opening that surrounds an outboard portion of the drive transmitting gear, and the method may also include removing the gear support before positioning the supplemental support member into the open space. The method may also include replacing the gear support after positioning the supplemental support member into the open space. The cartridge may include a support post spaced from the axle by a distance greater than an outer radius of the drive transmitting gear, and positioning the supplemental support member into the open space may include positioning the supplemental support member between the axle and the support post. The support post may include a convex outer surface and the supplemental support member may include a concave aligning surface, and positioning the supplemental support member between the axle and the support post may include positioning the concave aligning surface to face the convex outer surface.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Also, it is to be understood that the phraseology and terminology used herein is for the purpose of description and should not be regarded as limiting.

DETAILED DESCRIPTION

Figure 1:
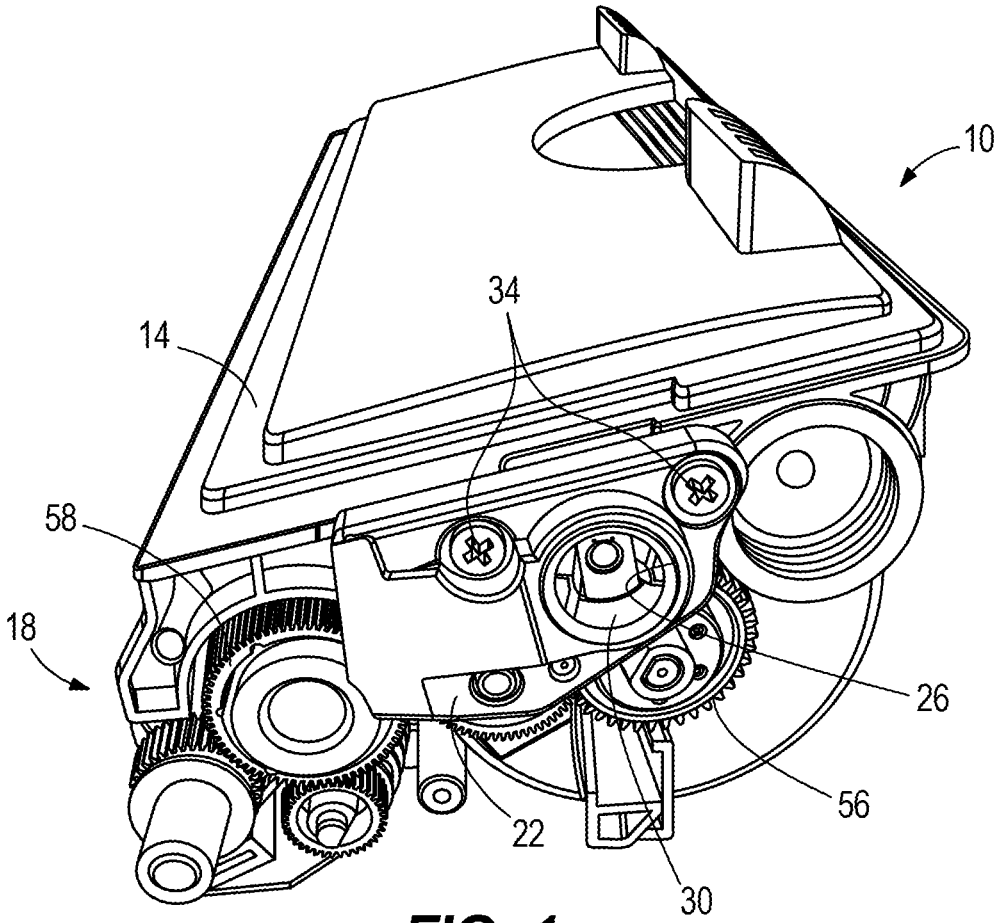
FIG. 1 is a perspective view of an exemplary toner cartridge that may be modified from its original configuration during remanufacturing to improve the ability of a drive receiving assembly to transmit torque received from a printer drive.
Figure 2:
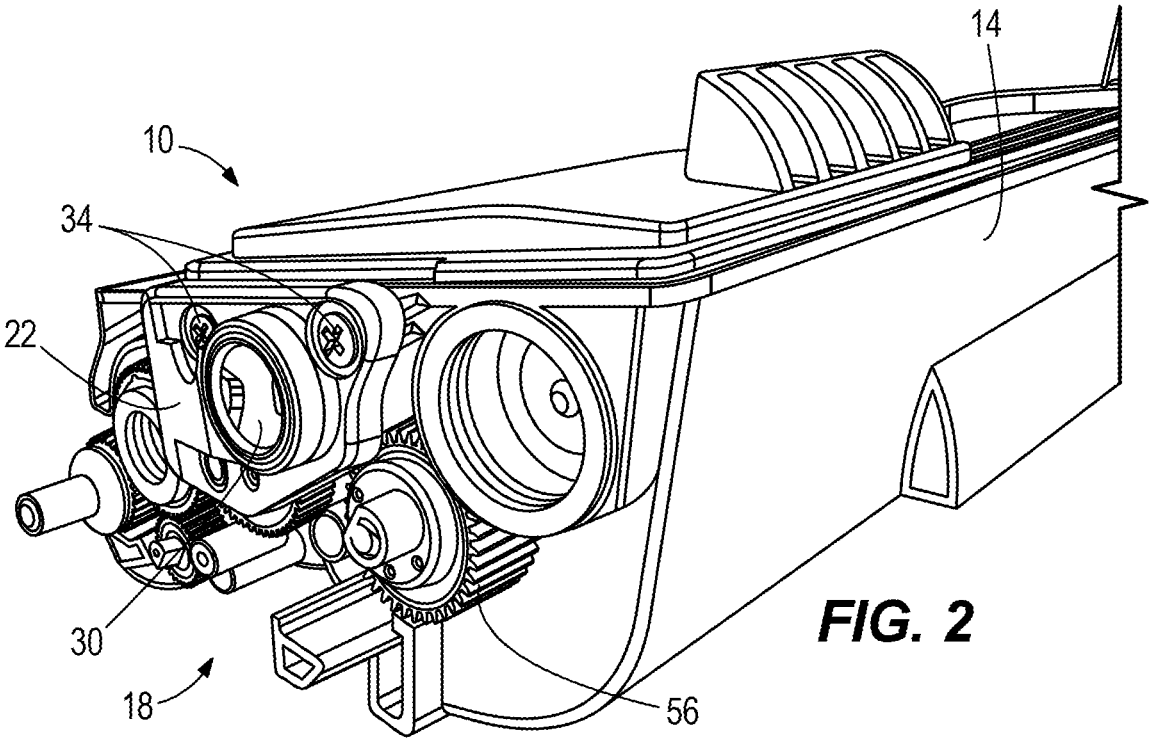
FIG. 2 is a perspective view of an end portion of the toner cartridge of FIG. 1 including the drive receiving assembly.

FIGS. 1 and 2 illustrate a toner cartridge 10 that includes a hopper section 14 and an end assembly 18 at one end of the hopper section 14. The end assembly 18 includes a gear support 22 defining an opening 26 that surrounds drive-receiving receptacle 30. The gear support 22 is secured to the end assembly 18 by a pair of screws 34. The drive-receiving receptacle 30 is configured to receive a drive projection (not shown) provided inside the printer into which the toner cartridge 10 is inserted for use. During print operations the drive projection engages with the drive-receiving receptacle 30 and transmits driving rotational force thereto, which in turn provides driving rotational force to various internal components of the toner cartridge 10, as described further below.

Figure 3:
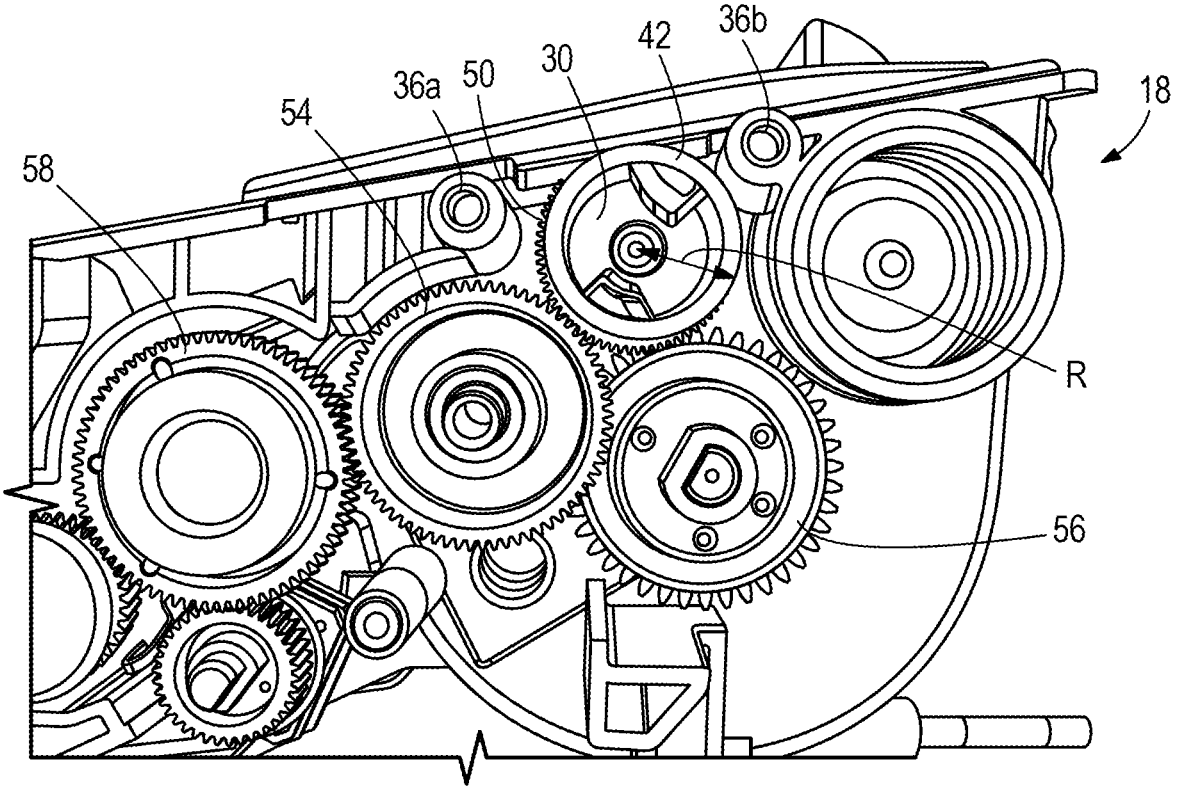
FIG. 3 is an end view of the drive receiving assembly of FIGS. 1 and 2 with a gear support removed to reveal details of the drive receiving assembly.
Figure 4:
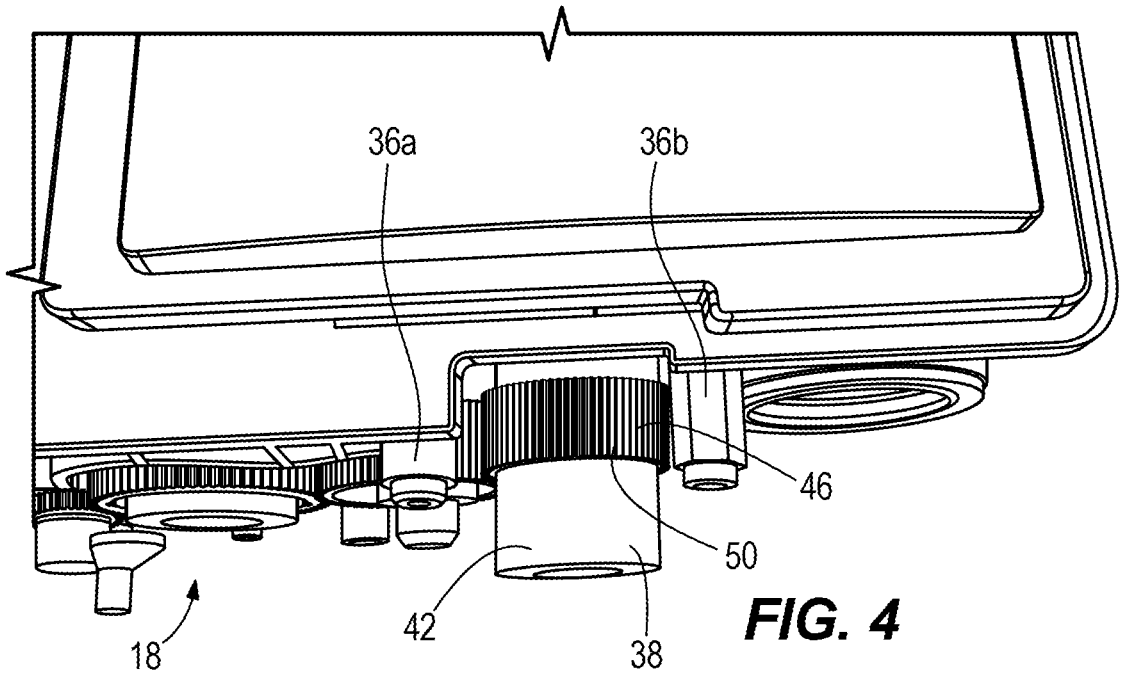
FIG. 4 is a top view of the drive receiving assembly of FIGS. 1 and 2.

Referring also to FIGS. 3 and 4, the gear support 22 may be removed by removing the two screws 34, each of which is received by a respective support post 36*a*, 36*b* positioned behind the gear support 22. With the gear support 22 removed it can be seen that the drive-receiving receptacle 30 is defined by an outboard portion 38 of a drive transmitting gear 42. The drive transmitting gear 42 includes the outboard portion 38, which in the illustrated construction is smooth, and an inboard portion 46, which in the illustrated construction includes gear teeth 50. The gear teeth 50 of the drive transmitting gear 42 engage with an intermediate gear 54 that drives an agitator gear 56 and, via a second intermediate gear 58, other components of the toner cartridge 10 such as the adder roller and developer roller, all in a manner generally understood by those skilled in the art. Taken together the drive transmitting gear 42, the intermediate gear 54, the agitator gear 56, the second intermediate 58, and other gears for driving other components of the toner cartridge 10 define a drive receiving assembly for transmitting torque received from the printer drive system to the components of the toner cartridge 10. Those skilled in the art will readily appreciate that different types of toner cartridges may include more, fewer, and/or different components and combinations thereof that are driven by a drive transmitting gear 42 similar to the one illustrated and described herein.

Figure 5:
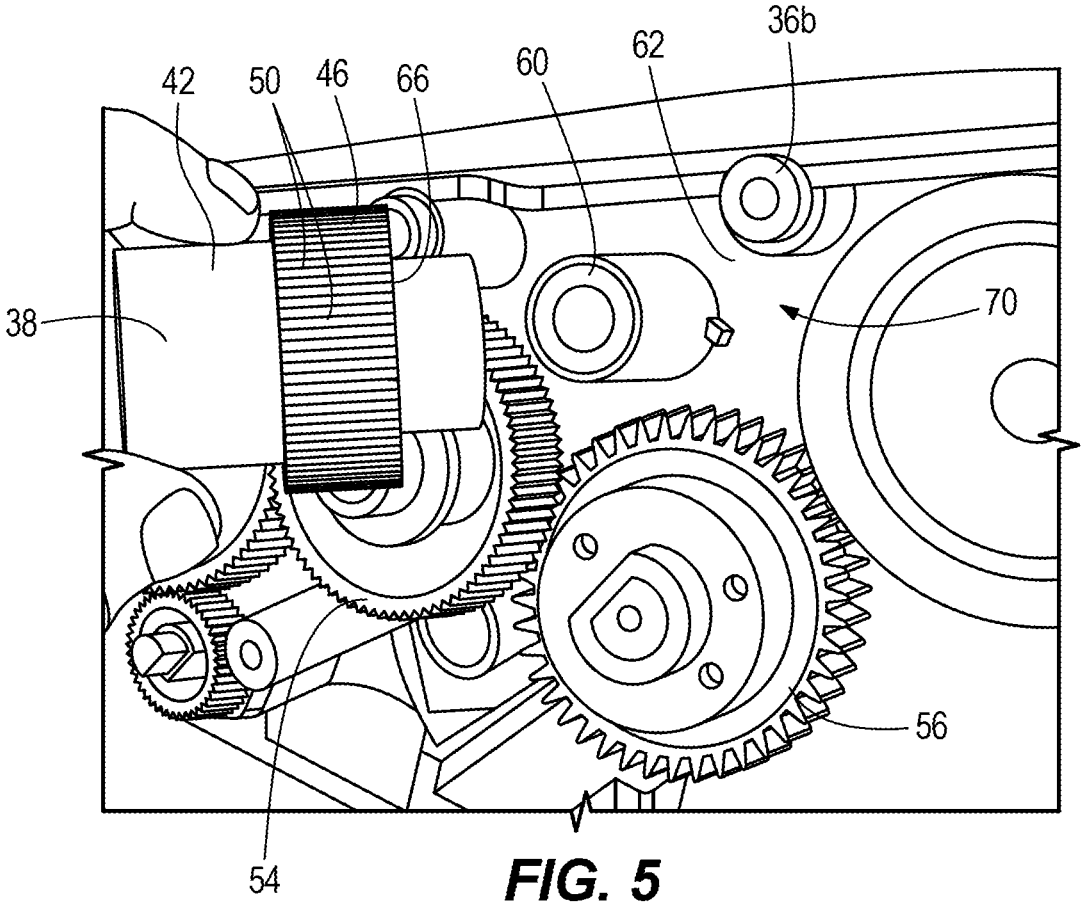
FIG. 5 is a partially exploded perspective view of a portion of the drive receiving assembly of FIGS. 1 and 2 with a drive transmitting gear removed from its supporting axle.
Figure 6:
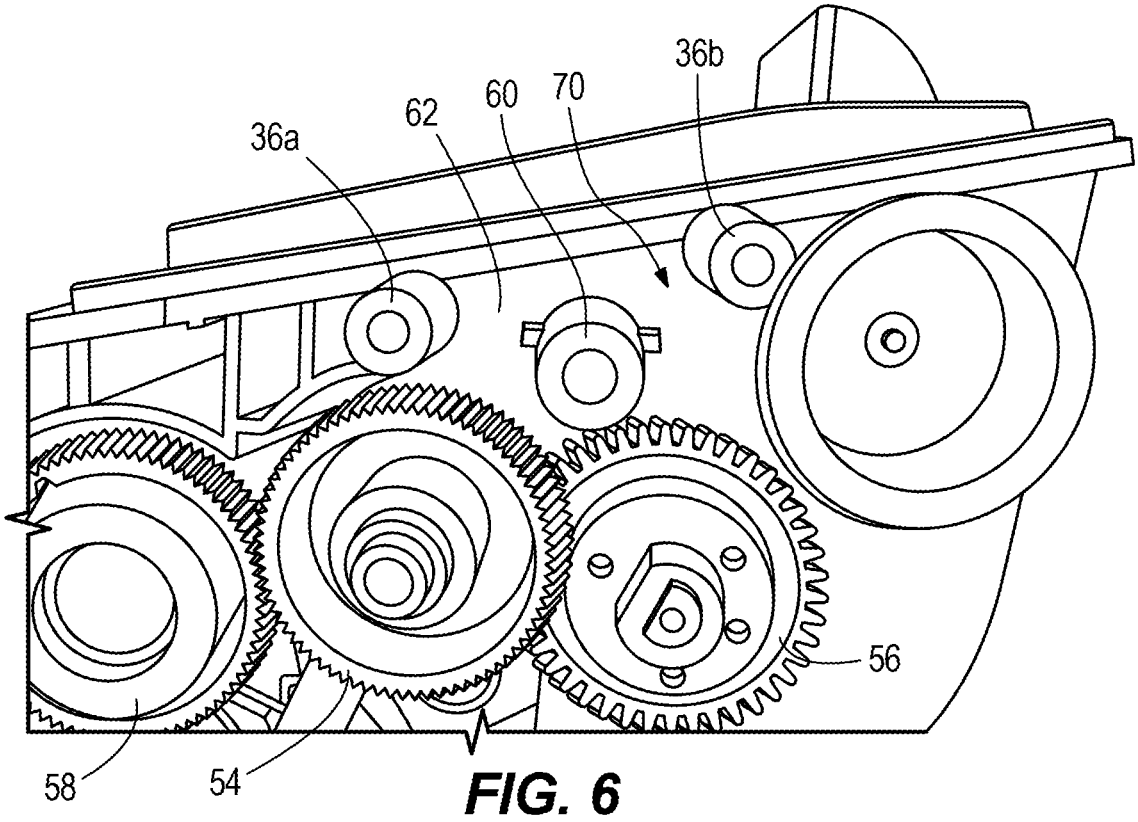
FIG. 6 is an end view of the drive receiving assembly of FIGS. 1 and 2 with the drive transmitting gear removed from its supporting axle.
Figure 7:
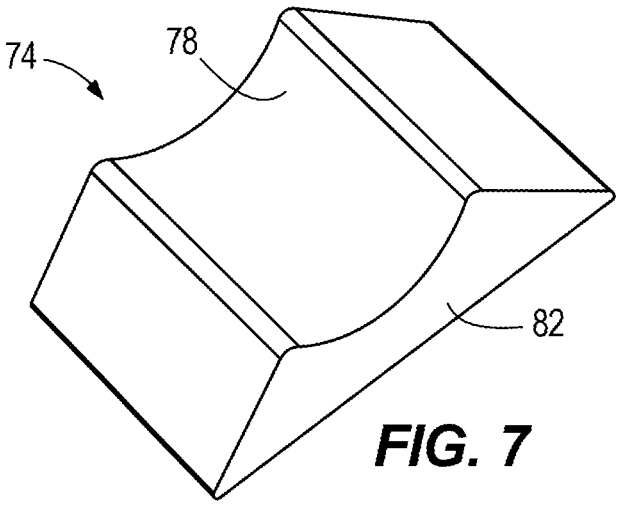
FIG. 7 is a perspective view of a supplemental support member configured for installation in the drive receiving assembly of FIGS. 1 and 2.

Referring also to FIGS. 5 and 6, the drive transmitting gear 42 is supported for rotation by an axle 60 oriented substantially perpendicularly relative to a side surface 62 of the toner cartridge 10. The drive transmitting gear 42 also can be seen to include an overhanging flange portion 66 that is spaced from the side surface 62 to provide clearance for the agitator gear 56. When the drive transmitting gear 42 is positioned upon the axle 60, the flange portion 66 and the side surface 62 define an open space 70 therebetween in a location generally above (as viewed in FIGS. 5 and 6) the agitator gear 56. The open space 70 is also partially defined by the support post 36*b*, which is spaced from the axle 60 by a distance that is greater than an outer radius R of the drive transmitting gear 42.

When remanufacturing a toner cartridge, such as the toner cartridge 10, one area of interest is the rotational force or torque required to rotate the drive transmitting gear 42 and the various cartridge components that it drives. Because remanufactured cartridges may include replacement components, different toners or developers, and/or more toner or developer than a new OEM cartridge, in some cases a remanufactured cartridge may require more rotational force than a new OEM cartridge of the same type. With respect to the toner cartridge 10, it was discovered that even a modest increase in the amount of rotational force required to drive the cartridge would lead to gear skipping between the drive transmitting gear 42 and the intermediate gear 54.

Figure 8:
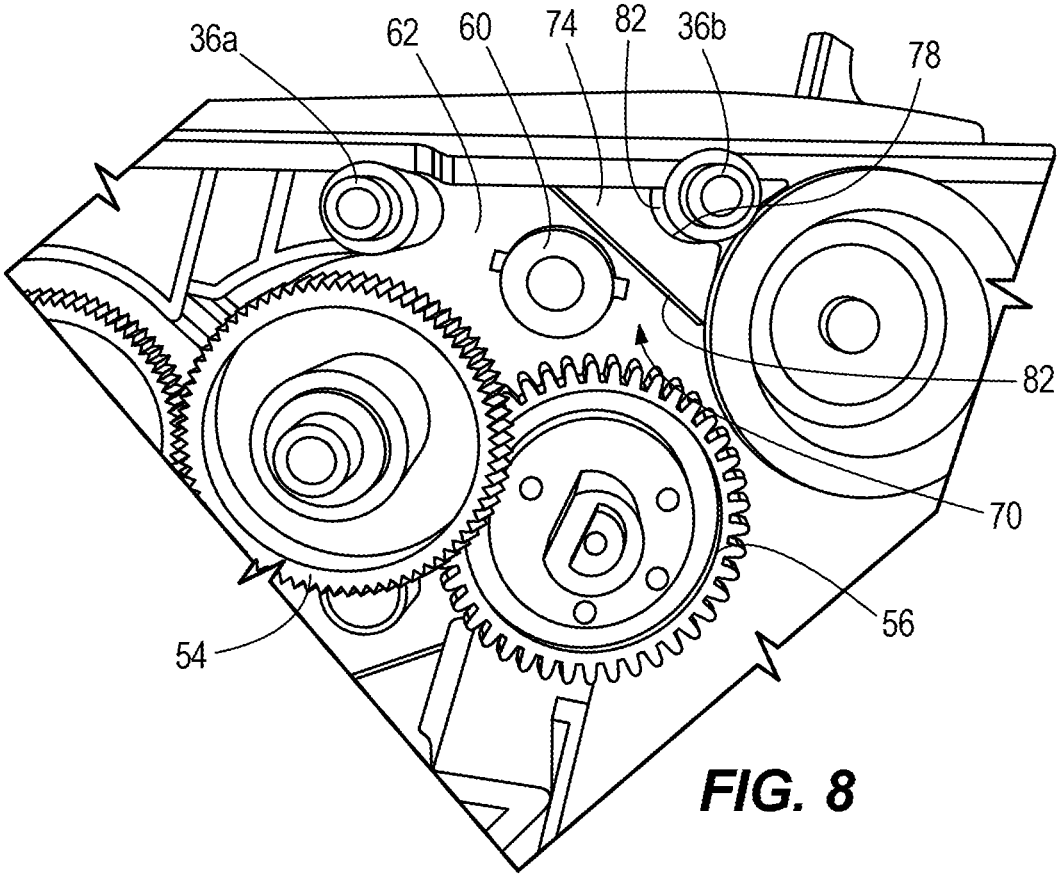
FIG. 8 is an end view of the drive receiving assembly of FIGS. 1 and 2 with the drive transmitting gear removed and the supplemental support member of FIG. 7 installed.

With reference also to FIGS. 7-10, to reduce gear skipping between the drive transmitting gear 42 and the intermediate gear 54, a supplemental support member 74 is provided and is inserted into the open space 70 between the flange portion 66 and side surface 62 and between the axle 60 and the support post 36*b*. The supplemental support member 74 has a generally trapezoidal shape except that what would be the short parallel edge of the trapezoid is replaced with a semi-circular concave aligning surface 78. As shown in FIG. 8, the concave aligning surface 78 is configured to face a semi-circular convex outer surface 82 of the support post 36*b*. A long straight edge 82 of the supplemental support member 74 faces toward the axle 60.

Figure 9:
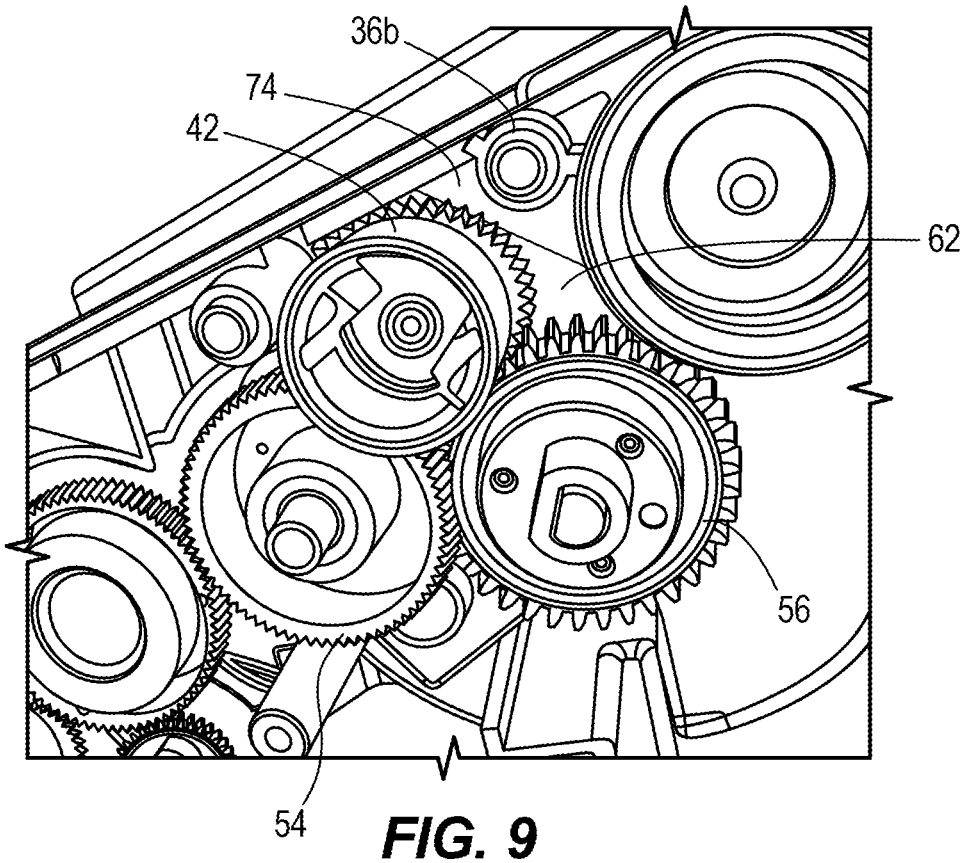
FIG. 9 is a perspective view of the drive receiving assembly of FIGS. 1 and 2 with the drive transmitting gear reinstalled over the supplemental support member of FIG. 7.
Figure 10:
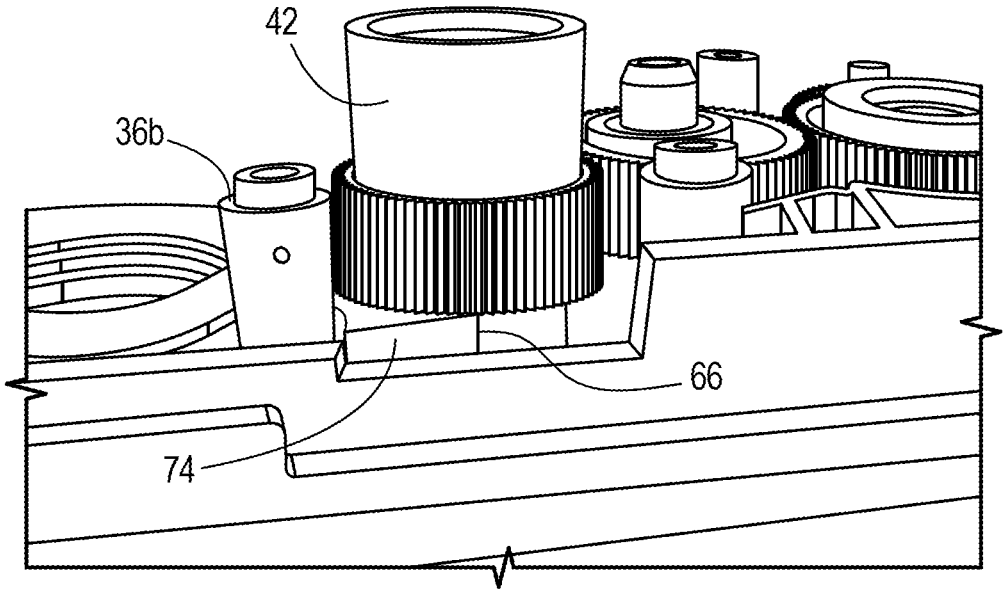
FIG. 10 is another perspective view of the drive receiving assembly of FIGS. 1 and 2 with the drive transmitting gear reinstalled over the supplemental support member of FIG. 7.

As best shown in FIGS. 9 and 10, the supplemental support member 74 has a thickness that generally corresponds to a distance between the side surface 62 of the toner cartridge 10 and the flange portion 66 of the drive transmitting gear 42. In this way the supplemental support member 74 limits movement of the overhanging flange portion 66 toward the side surface 62. With the supplemental support member 74 positioned in the open space 70, deflection of the axle 60 and the drive transmitting gear 42 while the drive transmitting gear 42 transmits rotational force to the intermediate gear 54 is reduced, which in turn reduces the likelihood of gear skipping between the drive transmitting gear 42 and the intermediate gear 54 during printing operations.

The supplemental support member 74 may be installed during original manufacturing of the toner cartridge 10 when new or during remanufacturing of the toner cartridge 10 after an initial use during which the supplemental support member 74 was not present. According to one exemplary embodiment, a method of remanufacturing the toner cartridge may include obtaining the toner cartridge 10, which as discussed above may include the drive transmitting gear 42 supported for rotation by the axle 60, which is oriented substantially perpendicularly relative to the side surface 62 of the toner cartridge 10. The toner cartridge may also include the gear support 22 defining the opening 26 that surrounds the outboard portion 38 of the drive transmitting gear 42. The drive transmitting gear 42 may include the overhanging flange portion 66 that faces and is spaced from the side surface 62 to define the open space 70 between the side surface 62 and the overhanging flange portion 66.

With the toner cartridge 10 obtained, the gear support 22 may be removed by removing the two screws 34 from their respective support posts 36*a*, 36*b* and pulling the gear support 22 away from the side surface 62. With the gear support 22 removed the drive transmitting gear 42 may be removed from the axle 60 by pulling it away from the side surface 62. Removing the drive transmitting gear 42 provides access to the open space 70 such that the supplemental support member 74 may be positioned into the open space 74 between the axle 60 and the support post 36*b* with the concave aligning surface 78 of the supplemental support member 74 facing the convex outer surface 82 of the support post 36*b*. With the supplemental support member 74 in position, the drive transmitting gear 42 may be replaced onto the toner cartridge 10 by reinstalling it onto the axle 60. With the drive transmitting gear 42 reinstalled the gear support 22 may be replaced onto the toner cartridge 10 by repositioning it over the drive transmitting gear 42 and reinstalling the screws 34 into their respective support posts 36*a*, 36*b*. With the supplemental support member 74 positioned in the open space 70, deflection of the drive transmitting gear 42 because of increased rotational forces during printing operations may be reduced, thereby reducing the occurrence of gear skipping within the drive receiving assembly.

It should be appreciated that the exemplary description provided above refers to one specific style of toner cartridge, but that the teachings and concepts set forth may be applied to a variety of toner cartridges having different forms of construction. For example, other toner cartridges may have a different arrangement of end caps, gears, and the like such that more or fewer components are modified or removed to prevent the toner seal from being removed during a post test. In addition, the method steps described above are not necessarily required to be performed in the order in which they are described, and not all method steps will be necessary for all types of toner cartridges.

Accordingly, the scope of the invention shall be defined by the following claims and the foregoing exemplary descriptions should not be regarded as limiting.

What is claimed is:

1. A method of remanufacturing a toner cartridge comprising:

obtaining an original toner cartridge including a drive transmitting gear supported for rotation by an axle oriented substantially perpendicularly relative to a side surface of the cartridge, the drive transmitting gear including an overhanging flange portion that faces and is spaced from the side surface of the cartridge to define an open space between the side surface and the overhanging flange portion; and positioning a supplemental support member into the open space, the supplemental support member not being part of the original toner cartridge and being configured to limit movement of the overhanging flange portion toward the side surface.

2. The method of claim 1, further comprising removing the drive transmitting gear from the toner cartridge before positioning the supplemental support member into the open space.

3. The method of claim 2, further comprising replacing the drive transmitting gear onto the toner cartridge after positioning the supplemental support member into the open space.

4. The method of claim 1, wherein the toner cartridge includes a gear support defining an opening that surrounds an outboard portion of the drive transmitting gear, the method further comprising removing the gear support before positioning the supplemental support member into the open space.

5. The method of claim 4, further comprising replacing the gear support after positioning the supplemental support member into the open space.

6. The method of claim 1, wherein the cartridge includes a support post spaced from the axle by a distance greater than an outer radius of the drive transmitting gear, and wherein positioning the supplemental support member into the open space includes positioning the supplemental support member between the axle and the support post.

7. The method of claim 6, wherein the support post includes a convex outer surface and the supplemental support member includes a concave aligning surface, and wherein positioning the supplemental support member between the axle and the support post includes positioning the concave aligning surface to face the convex outer surface.

* * * * *